US011536057B2

(12) United States Patent
Töpfer et al.

(10) Patent No.: US 11,536,057 B2
(45) Date of Patent: Dec. 27, 2022

(54) MOTOR VEHICLE LOCK

(71) Applicant: Kiekert AG, Heiligenhaus (DE)

(72) Inventors: Claus Töpfer, Sindelfingen (DE); Winfried Schlabs, Bochum (DE); Tim Sonnenschein, Wuppertal (DE); Inga Heinzen, Krefeld (DE)

(73) Assignee: Kiekert AG, Heiligenhaus (DE)

( * ) Notice: Subject to any disclaimer, the term of this patent is extended or adjusted under 35 U.S.C. 154(b) by 478 days.

(21) Appl. No.: 16/347,296

(22) PCT Filed: Nov. 7, 2017

(86) PCT No.: PCT/DE2017/100942
§ 371 (c)(1),
(2) Date: May 3, 2019

(87) PCT Pub. No.: WO2018/082751
PCT Pub. Date: May 11, 2018

(65) Prior Publication Data

US 2019/0292816 A1 Sep. 26, 2019

(30) Foreign Application Priority Data

Nov. 7, 2016 (DE) ..... 10 2016 121 190.7
Nov. 7, 2016 (DE) ..... 10 2016 121 191.5
(Continued)

(51) Int. Cl.
*E05B 77/26* (2014.01)
*E05B 77/28* (2014.01)
(Continued)

(52) U.S. Cl.
CPC ..... *E05B 77/26* (2013.01); *E05B 77/28* (2013.01); *E05B 79/20* (2013.01); *E05B 81/06* (2013.01);
(Continued)

(58) Field of Classification Search
CPC ..... E05B 77/26; E05B 77/28; E05B 79/20; E05B 81/06; E05B 79/22; E05B 81/16; E05Y 2201/654; E05Y 2900/50
See application file for complete search history.

(56) References Cited

U.S. PATENT DOCUMENTS 6,523,376 B2 * 2/2003 Baukholt ..... E05B 81/14 292/201
2014/0319847 A1 * 10/2014 Uehara ..... E05B 77/265 292/97

FOREIGN PATENT DOCUMENTS

DE 10000639 A1 7/2001
DE 10139975 A1 * 4/2002 ..... B22D 19/0009
(Continued)

OTHER PUBLICATIONS

International Search Report and Written Opinion for corresponding Patent Application No. PCT/DE2017/100942 dated Feb. 21, 2018.

*Primary Examiner* — Kristina R Fulton
*Assistant Examiner* — James E Ignaczewski
(74) *Attorney, Agent, or Firm* — Renner, Otto, Boisselle & Sklar, LLP

(57) ABSTRACT

A locking device for a motor vehicle includes an actuating lever, a lock and at least one Bowden cable, which is arranged between the actuating lever and the lock, wherein the lock can be actuated by means of the actuating lever and with the help of the Bowden cable and a functional unit, which is arranged on the Bowden cable and has an electric drive, and wherein the lock can be actuated by means of the functional unit at least in an assisting manner or an actuation can be prevented.

14 Claims, 7 Drawing Sheets

(30) Foreign Application Priority Data

Nov. 7, 2016 (DE) ..... 10 2016 121 193.1
Nov. 7, 2016 (DE) ..... 10 2016 121 195.8
Nov. 7, 2016 (DE) ..... 10 2016 121 198.2
Nov. 7, 2016 (DE) ..... 10 2016 121 199.0

(51) Int. Cl.
*E05B 79/20* (2014.01)
*E05B 81/06* (2014.01)

(52) U.S. Cl.
CPC ..... *E05Y 2201/654* (2013.01); *E05Y 2900/50* (2013.01)

(56) References Cited

FOREIGN PATENT DOCUMENTS

| | | | | | |
|---|---|---|---|---|---|
| DE | 10046189 | B4 | | 4/2004 | |
| DE | 202005008151 | U1 | | 7/2006 | |
| DE | 102011121670 | A1 | | 8/2012 | |
| DE | 102011121670 | A1 | * | 8/2012 | ..... E05B 77/04 |
| DE | 102015104695 | A1 | | 10/2015 | |
| DE | 102015104695 | A1 | * | 10/2015 | ..... E05B 77/36 |
| DE | 202016100521 | U1 | | 2/2016 | |
| EP | 0153978 | A2 | | 9/1985 | |
| FR | 2941994 | A1 | | 8/2010 | |
| GB | 2506350 | A | * | 4/2014 | ..... E05B 5/003 |
| JP | 2005194712 | A | * | 7/2005 | |
| JP | 2012007319 | A | * | 1/2012 | |
| WO | WO-9849417 | A1 | * | 11/1998 | ..... E05B 79/20 |

* cited by examiner

MOTOR VEHICLE LOCK

FIELD OF DISCLOSURE

The invention relates to a locking device for a motor vehicle, comprising an actuating lever, a lock and a Bowden cable which is arranged between the actuating lever and the lock, wherein the lock can be actuated by means of the actuating lever and with the help of the Bowden cable and a functional unit, which is arranged on the Bowden cable and has an electric drive.

BACKGROUND OF DISCLOSURE

Looking at motor vehicles these days, Bowden cables are used in many ways. A Bowden cable offers the advantage that a functional element, such as for example a door latch, liftgate latch and/or hood latch can be operated remotely using the Bowden cable. Besides the easy way in which the Bowden cable can be laid and the difficult to access areas in the motor vehicle, the Bowden cable also offers the advantage of being able to transmit high forces. The Bowden cable has a Bowden cable core, that on the one hand is arranged or attached to an actuating element and on the other hand to a functional element, or is hooked into the actuating element and functional element. The Bowden cable core is inside a Bowden cable sleeve that on the one hand is used as a flexible guide and on the other hand acts as a counter bearing for the force transmission by being attached for example in the functional element and near the handle.

One example of the use of a Bowden cable in the motor vehicle is for instance revealed in DE 100 46 189 B4. A control unit arranged inside the motor vehicle that in this execution example is developed as a swiveling actuating lever, is connected to a door latch via a Bowden cable. When actuating the control unit, the Bowden cable core actuates a swiveling lever in the door latch.

A further application of a Bowden cable in the motor vehicle is revealed in EP 0 153 978 B1. This shows the use of a Bowden cable to actuate a hood latch, whereby the Bowden cable is securely fixed in the motor vehicle and the motor hood latch can be unlocked by means of a control element arranged inside the motor vehicle. Apart from its mere function of opening the motor hood, the printed publication reveals an anti-theft lock that is arranged on the Bowden cable. The anti-theft lock hereby consists of a functional unit with an electric drive.

In order to integrate the functional unit in the Bowden cable, the Bowden cable sleeve is split and has a clip that is fixed to the Bowden cable core. The clip is arranged in such a way on the Bowden cable that the Bowden cable can be actuated manually under normal conditions. To obtain an anti-theft lock, the functional unit has a roof tile-shaped element that can be placed over the Bowden cable core and next to the clip onto the Bowden cable core so that the mobility of the Bowden cable core is inhibited in relation to the Bowden cable sleeve. The functional unit hereby inhibits the function of the Bowden cable, thereby preventing the opening of the motor hood.

SUMMARY OF DISCLOSURE

The purpose of the invention is to provide an improved locking device for a motor vehicle. In addition to this, the purpose of the invention is to simplify the operability of a locking device, whereby in particular an increased level of comfort should be achievable and where a constructively simple and cost-effective solution should be attainable.

The task is solved by the characteristics of the present disclosure. Advantageous designs of the invention are specified in the disclosure. It is pointed out that the exemplary embodiments described hereafter are not restrictive; instead, any variations are possible of the characteristics described in the description.

The purpose of the invention is solved by a locking device for a motor vehicle, comprising an actuating lever, a lock and at least one Bowden cable which is arranged between the actuating lever and the lock, wherein the lock can be actuated by means of the actuating lever and with the help of the Bowden cable and a functional unit, which is arranged on the Bowden cable and has an electric drive, and wherein the lock can be actuated by means of the functional unit at least in an assisting manner or an actuation can be prevented. By actuating the lock by means of the functional unit, this opens up the possibility that the lock can for example be unlocked or locked independently or at least to some extent independently. This simply requires initialization from the user to trigger or stop a function in the lock. The user simply has to initialize the pulse or signal to actuate the functional unit indirectly or directly.

Initialization can take place in several different ways. It is therefore conceivable for instance that initialization is realized by means of the actuating lever, whereby the movement of the actuating lever is captured by a sensor or switching element. In addition to this, it is conceivable that for instance initialization is realized by means of a remote control, so that the functional unit receives a control signal to actuate the lock. It is also conceivable that initialization is initiated through the Bowden cable itself or at least part of the Bowden cable, whereby a switching element can be actuated indirectly or directly by means of the Bowden cable, and whereby the functional unit receives signal to actuate the Bowden cable or lock.

Various locks and actuating levers can be used as a locking device for a motor vehicle. The locking device can be used as a compact constructional unit, for example in a lateral door, a sliding door or in the vicinity of flaps or lids or covers. Furthermore, it is also conceivable that for instance hood latches, auxiliary locks, as found for example in transporters, are used.

An internal or external actuating lever may for example be used as an actuating lever, such as for example a door handle. It is however also conceivable that sensitive means such as touch-sensitive switches and/or pressure switches or buttons are used to initialize the functional unit.

The locking device is used where a Bowden cable is used between the actuating lever and a lock. The Bowden cable consists of a Bowden cable sleeve and a Bowden cable core, whereby the Bowden cable sleeve is split, in other words, is made up of at least two parts that on the one hand support themselves in the actuating lever and in the functional unit and on the other hand in the functional unit and the lock to be actuated. To put it another way, the Bowden cable sleeve consists of at least two parts and extends from between the actuating lever and the functional unit and the functional unit and the lock to be actuated. The retainer surfaces or retainers for the ends of the parts of the Bowden cable sleeve in the actuating element or on the actuating element, functional unit and in or on the lock are retained in such a way that the Bowden cable sleeve is supported. Bowden cable sleeve parts that are fixed in the actuating lever, functional unit and lock are preferable.

The functional unit includes an electric drive that after initialization or after having received a control signal, moves the functional unit in such a way that the lock can be actuated or at least actuated in an assisting manner by means of the functional unit. The electric drive is preferably an electric motor. Electric motors are advantageous, since they are quiet, are available in a wide range and can be easily integrated in a motor vehicle or functional unit. If the lock is then subsequently actuated by means of the functional unit, then according to the invention, the operability of the locking device is simplified which in turn helps increase the comfort of the motor vehicle.

In one embodiment, the Bowden cable core can be deflected by means of the functional unit. Deflecting the Bowden cable core allows a force to be applied to the Bowden cable core. This can for example happen because the Bowden cable core, through the deflection unit next to a guide in the deflection unit, has means that allow an additional force to be applied to the Bowden cable core, thereby introducing a torque or a force into the Bowden cable core. In the simplest case, this can for example be realized by a positive-fitted and/or frictional connection between the deflection unit and Bowden cable core. The deflection unit works in combination with the electric drive so that the deflection unit introduces a force into the Bowden cable core. This can for example happen because the deflection unit is fed into the functional unit so as to be longitudinally displaceable and so that when the deflection unit moves, the Bowden cable core is carried along, thereby making it possible for a force to be introduced into the Bowden cable core.

If the Bowden cable can be deflected by a pivotable deflection unit arranged in the functional unit, in particular a disk element, then this is another advantageous embodiment of the invention. A disk element that acts as a deflection unit offers the advantage here that the deflection unit can be easily housed in the functional unit. The introduction of a force by means of an electric drive is also easily achievable and can for example be realized through the direct actuation of the deflection unit. If the Bowden cable or Bowden cable core is hereby actuated by means of the actuating lever, then a switching device arranged on or in the actuating lever can for example generate a signal that initiates the electric drive, thereby actuating the deflection unit. As a result of the initialization of the drive, the deflection unit and in particular the disk element are powered, which in turn leads to the actuation of the Bowden cable.

The operator of the motor vehicle is then free to simply commence the initialization of the functional unit to open the lock or the operator continues to actuate the actuating lever and the lock is opened or unlocked in an assisting manner. If the operator actuates the actuating lever merely to initialize the functional unit, then the lock can be actuated and/or unlocked and/or locked by means of the functional unit. In each instance, the functional unit is able to strengthen the signal initiated by the operator in the functional unit or trigger an actuation of the lock itself.

In one further embodiment of the invention, there is an advantage when an initial deflection unit is provided and that the initial deflection unit can be connected to one end of an initial part of the Bowden cable core and that a second deflection unit is provided and that the second deflection unit can be connected to one end of a second part of the Bowden cable core. In this embodiment, it is not merely the Bowden cable sleeve that consists of several parts but also the Bowden cable core in the functional unit. The functional unit therefore contains an initial deflection element and in particular a deflection disk or a disk element, into which one end of the Bowden cable core can be suspended or connected to the deflection unit. The first part of the Bowden cable sleeve is hereby fixed between the actuating lever and the functional unit, whereby the first part of the Bowden cable core works together with the actuating lever and the first deflection unit. If the actuating lever is pulled, a force is initiated into the first deflection unit and the deflection unit pivots for example.

According to the invention, a second deflection unit is provided in the functional unit that interacts with the first deflection unit. A second end of the Bowden cable core is suspended into the second deflection unit or is connected to the deflection unit in such a way that a force can be initiated into the Bowden cable core. The combination of two deflection units brings about a series of benefits. On the one hand, a deflection unit can act as a drive disk for the functional unit and on the other hand, the second deflection unit can for example designed to work together with a switching device. In addition to this, there is also the advantage that through two coactive deflection units that are designed as separate components, a coupling can be developed. If the deflection units only work together in one direction of rotation, then a coupling element can be created by means of the deflection units.

In addition to this, a separate actuation of the deflection units is possible. If for example the actuating lever is used to actuate the first deflection unit with the first part of the Bowden cable core, then a switching device on the first deflection unit can be used to initialize the drive unit, whereby the second deflection unit can be actuated. If, in doing so, the second deflection unit is actuated by means of the electric drive, then the second deflection unit can be actuated independently from the first deflection unit. If only the switching signal is initiated by the first deflection unit, then the lock can be actuated by means of the functional unit, without the first deflection unit having to execute a movement that would have been required to open or unlock the lock. Only the second deflection unit that is actuated through the electric drive, is hereby moved so far that the function in the lock can be actuated. For that purpose, there is at least unilaterally a freewheel between the first deflection unit and the second deflection unit.

If the first and second deflection unit can be coupled, then this results in a further advantageous embodiment of the invention. Coupling the deflection units can for example be realized via a positive-fitted connection between the first and second deflection unit. The first deflection unit on the periphery can hereby for example exhibit an increase that can be achieved with an increase on the second deflection unit. If the first deflection unit is actuated, then the first deflection unit carries the second deflection unit along, and after the second deflection unit has been initiated, the second deflection unit can release itself from the first deflection unit, in other words it can move independently and irrespective of the deflection unit. The second deflection unit hereby works in a coupled manner with the first deflection unit but has a freewheel.

If a drive element is provided, whereby the drive element can actuate the first and/or second deflection unit, then this is a further embodiment of the invention. The development of a separate drive element, for example in the form of an additional disk or gear segment, allows a defined force to be initiated in the functional unit or the adequate force needed to open the lock or actuate the lock to be provided. It is therefore conceivable for instance that the drive element is used as a third separate component in addition to the two deflection units in the functional unit. An arrangement can therefore for example include a first level where a first deflection unit is arranged, a second level above the first deflection unit where the second deflection unit is arranged and above the second deflection unit, is the drive element. Both deflection units and the drive element can be secured to the same rotational axis. The rotational axis is securely connected to a housing of the functional unit or can be designed as a single part with the housing of the functional unit. This allows for a compact design of the functional unit. A model structure like this of the functional unit can on the one hand produce a coupling element between the first and second deflection unit and on the other hand the drive element can provide sufficient force for actuation purposes, as well as to achieve the speed needed to actuate the lock. The drive element preferably has a gear segment into which the electrical drive unit and in particular a gear of the electric drive engages. It is also conceivable that a worm drive is formed between the drive element and electric motor.

In particular to achieve the necessary actuation speed and to achieve a suitable torque, in an advantageous embodiment of the invention it is conceivable that the drive unit can be powered by an electric drive and by a transmission gear. By having a transmission gear between the electric motor and the drive element, torques can be generated in a definable and specified manner on a circular drive disk as the drive element. It is hereby advantageous if the drive element is a single piece or has a separate component as gear segment that works together with the electric drive or transmission gear.

In an advantageous embodiment, the functional unit has a control lever, whereby the control lever works together with the first or second deflection unit. The control lever is used here to give the operator haptic feedback that an initialization has occurred, in other words, the switching of the switching device. The control lever can for example be arranged spring-pretensioned to the first or second deflection unit and for example work together positively with the deflection unit. If for example the first deflection unit reaches an angle of rotation, then the control lever and deflection unit engage positively and the operator receives haptic feedback, so that for example the movement of the actuating lever can be limited.

The tight fit between the deflection unit and control lever is such that by pulling the actuating lever firmly or repeatedly, the deflection unit can be moved beyond the stop. The stop on the deflection unit is merely used to signal to the operator that the switching device is actuated and the function is executed on the lock. If in the event of a power cut for instance, the drive of the functional unit is not initialized, then the operator always has the option to actuate the lock manually.

With the functional unit, the operator of the motor vehicle hereby has a driver assistance module or an opening module that simplifies the operation of the motor vehicle, thereby providing increased comfort for the motor vehicle.

1st Embodiment: Procedure and Device to Electrically Open a Lock by Means of an Electric Opening Module (eÖFM)

In a 1st embodiment, the motor vehicle lock can be actuated electrically by means of the functional unit. An electrical actuation can hereby be realized for example by means of a switching device and in conjunction with a control unit of the motor vehicle. An external door handle can therefore for example include a microswitch or for example a proximity switch, where the operator of the motor vehicle can transmit a signal to the control system and ultimately to the functional unit. The electric signal for example causes an electric motor to be actuated, whereby the motor vehicle lock can be opened or unlocked by means of the electric motor. The motor vehicle lock can subsequently be opened electrically by means of a control signal. To activate the functional unit, this simply requires an electric connection between a medium for actuation and the functional unit.

In addition to this, it is also conceivable that for example the electric actuation of the functional unit is initialized via a microswitch or switching device arranged in the functional unit. It is therefore for example possible to pull a Bowden cable that works together with the functional unit so that a switching device can be actuated. The switching device itself is then connected to the control unit so that the electric drive can be actuated and the motor vehicle lock can be opened.

If the functional unit has an actuator, whereby the actuator can be actuated by means of the electric drive and the actuator works together with the Bowden cable in such a way that the motor vehicle lock can be actuated, then this is a further embodiment of the invention. A control member can be designed as a linear movable actuator or as a disk element, whereby the disk element performs a circular movement. In each instance, the actuator is connected to one part of a Bowden cable that works directly with the motor vehicle lock. The actuator can then be driven linearly or rotatory by means of the electric drive. The actuator hereby moves in such a way that the Bowden cable is actuated and the motor vehicle lock can for example be unlocked or actuated.

In one further embodiment, the medium for actuating a signal sender, in particular an electric switching device, whereby the electric drive can be activated by means of the signal sender. If the medium for actuating is actuated or switched, then the electric drive is also actuated so that the automatic actuation of the Bowden cable and therefore also of the motor vehicle lock is possible. The actuator or signal sender can be activated for example via an external door handle that in turn is connected to an electronic control unit that then initializes the signal sender and activates the electric drive. The external door handle can therefore be used to actuate the functional unit and the motor vehicle lock can be unlocked or opened via the functional unit. The signal sender hereby initializes the electric drive in such a way that the actuator is moved and that the Bowden cable can be actuated by means of the actuator and the motor vehicle lock by means of the Bowden cable.

In one further embodiment of the invention, at least one other medium is provided to actuate the functional unit, whereby the additional actuation medium works together with the functional unit in such a way that the motor vehicle lock can be actuated optionally by means of the electric drive and/or the Bowden cable. The additional actuation medium can for example be an interior door handle that is connected to the functional unit by means of a Bowden cable. The interior door handle is connected to the functional unit in such a way that a Bowden cable is provided between the interior door handle and the functional unit.

The Bowden cable can hereby be used to either actuate the signal sender so that the electric drive can move the actuator, or the interior door handle is pulled so that the signal sender is initialized and the electric drive starts, so that when pulling the interior door handle, the movement of the interior door handle is supported to allow the motor vehicle lock to open slightly. In addition to this, the mechanical actuation of the functional unit by means of the interior door handle can also lead to a mechanical initialization, in other words, a mechanical movement of the actuator, to enable a purely mechanical opening of the motor vehicle lock. Every alternative provides an actuating medium through the additional actuating medium, that can be used to activate or actuate the functional unit. The actuating medium for example as external door handle can hereby enable the purely electrical opening of the motor vehicle lock, whereas the interior door handle provides alternative opening variants.

If the actuator is arranged in such a way in the functional unit that the actuator can be actuated optionally by means of the signal sender and electric drive or the additional actuating medium, then this is a further embodiment of the invention. The arrangement of the actuator as linear movable slider or for example in the form of a disk, is such that for example the interior door actuation engages unilaterally on the actuator, whereas the electric drive for example is arranged on an opposite side in the functional unit. It is of course also possible that the actuating medium that is connected to the interior door handle, at the same time works together with the electric drive, thereby only needing a small number of components to move the actuator. It is also conceivable that the electric drive acts directly on the actuator, whereby it is also for example conceivable that an electric motor has a worm that acts directly on a single-piece actuator.

It is also conceivable that the electric drive acts on a coupling medium that, when the electric drive is actuated, engages with the actuator so that the actuator can be moved. It is hereby also conceivable that the interior door handle engages with another component by means of the Bowden cable, that, when the interior door handle is actuated, engages with the actuator or is coupled into the actuator, so that the actuator can be actuated by means of the interior door handle.

It is hereby also conceivable, and a further embodiment of the invention, if the actuator is a coupling element. The actuator can hereby be designed as a two-sided coupling element. In other words, the actuator is designed in such a way that when the electric drive is actuated, the electric drive couples into the actuator and at the same time, if the interior door handle is actuated, the actuator is able to mechanically couple with the actuating medium of the interior door handle, to enable the actuation of the actuator. It is therefore conceivable for instance that the actuator is designed as a circular disk or at least a partial circular disk, whereby the actuation of the electric drive causes transmission unit at the very least designed as a partial circular disk to engage in the circular disk or actuator, in that the electric drive moves the transmission unit in a circular motion, thereby engaging with the actuator. At the same time, it is possible to actuate the interior door handle and in turn to actuate a transmission unit at the very least designed as a partial circular disk that then couples with the circular disk of the actuator.

In one further embodiment of the invention, the Bowden cable consists of several parts, in particular two parts, whereby the first part of the Bowden cable is arranged between the additional actuating actuator and the functional unit and a second part is arranged between the actuator and the motor vehicle lock. The functional unit can hereby be advantageously integrated in the multi-part Bowden cable. The functional unit can then be used to transmit a control signal to the motor vehicle lock via the interior door handle, whereby the functional unit acts as a connecting link or coupling element. The separated design or split design of the Bowden cable hereby makes it possible to connect the interior door handle with the first transmission medium in the functional unit, whereby the first transmission medium is merely connected to the first part of the Bowden cable. Separate to this, the second part of the Bowden cable is connected to the actuator, so that a movement of the actuator can be transmitted to the motor vehicle lock.

The separation of the Bowden cable hereby facilitates the independent movement of the first Bowden cable part and the second Bowden cable part. The functional unit hereby offers the option to selectively actuate the second part of the Bowden cable. This may merely be the transmission of an electric signal to the functional unit, so that the motor vehicle lock opens or a mechanical actuation of the functional unit takes place to enable the mechanical and/or electrical opening of the motor vehicle lock. The functional unit hereby acts as an opening module for the motor vehicle lock.

If the additional actuating medium works together with the actuator in such a way that haptic feedback can be captured by an operator of the additional actuating medium, then this is an alternative embodiment of the invention. The haptic feedback can for example be formed by a start-up contour on the actuator. If the interior door handle is then pulled, the operator receives haptic feedback informing him that the transmission unit has engaged with the actuator. The operator hereby receives feedback that allows him to safely actuate the actuator. The haptic feedback can also be sent by means of a spring medium or directly via a spring, so that the operator merely receives light or gentle feedback. The additional actuating medium hereby ends up on a control contour for example, so that on the one hand feedback can be sent to the operator and at the same time, the operator is informed that the actuator is being actuated. A freewheel can therefore for example be set for the interior door handle.

If the functional unit has a switching device, whereby the switching device is arranged in the functional unit in such a way that the haptic feedback can be captured after or directly by actuating the switching device. The haptic feedback on the transmission unit that works together with the first part of the Bowden cable, hereby engages in such a way with the switching device that the control contour can be directly captured by actuating the switching device. This makes it possible that the first part of the Bowden cable merely has to be actuated briefly in order to initialize the switching device and thereby activate the electric drive.

In this case, the functional unit acts as a comfort module, whereby the interior door handle merely has to be pulled until the switching device has been actuated. Full actuation of the Bowden cable, in other words, of the first and second part of the Bowden cable by means of the interior door handle, is hereby not necessary. Only the switching device has to be actuated to activate the electric drive which then acts upon the actuator in such a way that the motor vehicle lock is opened or actuated. Actuating the motor vehicle lock is hereby initialized by means of the interior door handle, whereby only the switching device has to be actuated by means of the interior door handle.

With a combination of haptic feedback from the actuation of the switching device, the operator can hereby be informed that the interior door handle has been pulled sufficiently to open the motor vehicle lock. Only in the case where there is insufficient voltage to actuate the electric drive, can the haptic feedback or the control contour be used to actuate the interior door handle, so that the actuator can be actuated manually. The functional unit hereby acts as a comfort module since the operator merely has to initialize the electric drive.

2nd Embodiment: Procedure and Device to Electrically Open a Lock by Means of an Electric Opening Module (eÖFM), Including an Anti-Theft Lock In one embodiment, the Bowden cable consists of at least two parts, whereby the first part of the Bowden cable is arranged between the activating medium and the functional unit and the second part is arranged between the functional unit and the motor vehicle lock and whereby actuation of the Bowden cable by means of the functional unit can be prevented. If actuation of the Bowden cable can be prevented by means of the functional unit, then the functionality of the functional unit is increased. Apart from the mere transfer of an opening initialization of the lock, there is now the option to map another function, such as for example an anti-theft lock in the functional unit. If for example the first part of the Bowden cable is connected to an interior door handle and the first part of the Bowden cable for example has an operative connection with a deflection unit in the functional unit, then by suspending the engagement of the deflection unit in the functional unit, the interior door handle can be disabled. This can for example be useful to map an anti-theft lock in the functional unit.

If the mechanical connection of the first part of the Bowden cable can be uncoupled from the second part of the Bowden cable, then this is another variant of the invention. If the first part of the Bowden cable is uncoupled from the second part of the Bowden cable, then the operative connection in the functional unit is prevented. Actuation of for example an interior door handle that is connected to the first part of the Bowden cable, then comes to nothing. The actuating medium, in this case the interior door handle, is hereby disabled without the need for another function to be mapped in the door lock. The uncoupling function of the Bowden cable is mapped in the functional unit.

If the uncoupling of the Bowden cable can be realized by means of the electric drive in the functional unit, then this is another variant of the invention. Using the electric drive in the functional unit to uncouple the Bowden cable reduces the number of components needed in the functional unit and at the same time increases the functionality of the functional unit. The electric drive can hereby be used to uncouple the first part of the Bowden cable, which can for example be realized via a mechanical coupling that can be routed or switched from the electric drive.

In addition to this, according to the invention it is possible that the motor vehicle lock can be actuated electrically by means of the functional unit. Electrical actuation of the motor vehicle lock by means of the functional unit in turn expanded the functional unit by another function. It is therefore conceivable for there to be a switching device on an external door handle, so that an operator actuates the switching device, such as for example a microswitch or a contactless switch. Actuation of the switching device can then be detected by means of a control unit and transmitted to the functional unit as an electric signal.

The functional unit then provides the option for example, by means of the electric drive in the functional unit, to actuate the second part of the Bowden cable, thereby converting the actuation from the operator into the opening of the motor vehicle lock. The electric drive can hereby perform two different functions. On the one hand, the connection between the first part of the Bowden cable and the second part of the Bowden cable can be prevented by means of the electric drive, and on the other hand there is also the option to open the motor vehicle lock independently, in other words automatically, by means of the functional unit and a switching signal.

If an actuator is provided, whereby the actuator can be activated from a starting position into different directions by means of the electric drive, then this is another variant of the invention. By utilizing the different directions of movement of the electric drive, functions can be selected in the functional unit using as few components as possible. A selection to the effect that an electric drive is used to either open the motor vehicle lock or for example disable an interior door handle. Depending on the position of the electric drive or the positions to be set in the functional unit by means of the electric drive, there is the option for example to move from an idle, middle or starting position into different directions. In one direction of movement, the motor vehicle lock can then for example be opened electrically, whereas in an opposite direction of movement of the electric drive, an anti-theft lock can be activated.

In one variant of the invention, a medium for positioning, in particular a middle zero-spring, an actuator is provided. The middle zero-spring enables the actuator to be held in a starting position. From this starting position, the actuator can then be moved in different directions, so that on the one hand the actuating medium can be uncoupled and on the other hand the actuator can be actuated electrically. The functional unit can hereby have three different functionalities. The first functional position is if for example the motor vehicle lock can be actuated by means of the Bowden cable, the actuator is hereby in an end position, whereby the second part of the Bowden cable is actuated in the direction of the motor vehicle lock. A second functional position is then if the middle zero-spring holds the actuator in the starting position, so that all functionalities of the functional unit are available. In a third functional position, the electric drive was moved in such a way that the first part of the Bowden cable is available uncoupled from the functional unit. The middle zero-spring holds the actuator in a starting position. If the additional actuating medium works together with the actuator in such a way that haptic feedback can be captured by an operator of the additional actuating medium, then this is an alternative embodiment of the invention. The haptic feedback can for example be formed by a start-up contour on the actuator. If the interior door handle is then pulled, the operator receives haptic feedback informing him that the transmission unit has engaged with the actuator. The operator hereby receives feedback that allows him to safely actuate the actuator. The haptic feedback can also be sent by means of a spring medium or directly via a spring, so that the operator merely receives light or gentle feedback. The additional actuating medium hereby ends up on a control contour for example, so that on the one hand feedback can be sent to the operator and at the same time, the operator is informed that the actuator is being actuated. A freewheel can therefore for example be set for the interior door handle.

If the functional unit has a switching device, whereby the switching device is arranged in the functional unit in such a way that the haptic feedback can be captured after or directly by actuating the switching device. The haptic feedback on the transmission unit that works together with the first part of the Bowden cable, hereby engages in such a way with the switching device that the control contour can be directly captured by actuating the switching device. This makes it possible that the first part of the Bowden cable is merely has to be actuated briefly in order to initialize the switching device and thereby activate the electric drive.

In this case, the functional unit acts as a comfort module, whereby the interior door handle merely has to be pulled until the switching device has been actuated. Full actuation of the Bowden cable, in other words, of the first and second part of the Bowden cable by means of the interior door handle, is hereby not necessary. Only the switching device has to be actuated to activate the electric drive which then acts upon the actuator in such a way that the motor vehicle lock is opened or actuated. Actuating the motor vehicle lock is hereby initialized by means of the interior door handle, whereby only the switching device has to be actuated by means of the interior door handle.

With a combination of haptic feedback from the actuation of the switching device, the operator can hereby be informed that the interior door handle has been pulled sufficiently to open the motor vehicle lock. Only in the case where there is insufficient voltage to actuate the electric drive, can the haptic feedback or the control contour be used to actuate the interior door handle, so that the actuator can be actuated manually. The functional unit hereby acts as a comfort module since the operator merely has to initialize the electric drive.

3rd Embodiment: Procedure and Device to Electrically Open a Lock by Means of an Electric Opening Module (eÖFM), Including an Anti-Theft Lock and a Child Safety Lock In one embodiment of the invention, the Bowden cable consists of at least two parts, whereby the first part of the Bowden cable is arranged between the activating medium and the functional unit and the second part is arranged between the functional unit and the motor vehicle lock and whereby actuation of the first part of the Bowden cable can be captured. If the functional unit is structured in such a way that actuation of the first part of the Bowden cable can be captured, then the capturing of the movement can be used to realize a child safety lock. In particular if the actuating medium is an interior door handle, then by capturing the movement the functional unit can be activated accordingly, so that the functional unit does not transfer, the actuation of the interior door handle, to the second part of the Bowden cable. Capturing the movement, for example by a control unit, then allows the control unit to prevent the actuation of the functional unit. The actuation of the functional unit by means of an actuating element, such as for example an interior door handle, can hereby be prevented, so that an anti-theft lock and/or a child safety lock is mapped in the functional unit.

If the capture can be performed by means of a switching device, in particular by means of a microswitch, then this is a further embodiment of the opening. If a switching device such as for example a microswitch or a touch-sensitive sensor or a capacitive sensor is arranged on the first part of the Bowden cable, then actuation of the interior door handle can be detected directly. Detection can for example occur by means of the control unit, so that the first part of the Bowden cable can be uncoupled, or if uncoupling has already taken place, then uncoupling can be maintained. It is also conceivable here that by means of the control, a single or multiple actuation of the interior door handle can be captured. Different variants of a child safety lock can hereby be mapped.

This means that for example by pulling the interior door handle once, that the interior door handle can be coupled back onto the functional chain of the second part of the Bowden cable, so that when the interior door handle is actuated twice or several times, the child safety lock can be engaged. In one variant, by for example pulling the interior door handle once, this could lead to the connection between the first and second part of the Bowden cable being restored, so that when the interior door handle is pulled a second time, the motor vehicle lock can be actuated or unlocked by means of the functional unit.

There is then an advantage when, depending on the switching position of the switching device, the motor vehicle lock can be actuated by means of the functional unit, whereby the functional unit can be actuated in at least one switching position of the switching device. The switching device is actuated preferably by means of the Bowden cable and even more preferably by means of the interior door handle. The switching device can hereby also be activated by means of the control unit, if for example a child safety lock or an anti-theft lock is to be inserted. This offers the advantage that the functional unit can perform additional functions, without the need to make changes to the door lock. The functional unit hereby adds functions to the locking device, and is in a position to provide a door lock with functions that are integrated in the functional unit, in other words, outside of the motor vehicle lock.

In one further embodiment, there is then the advantage if at least one other electric drive is provided, and if by means of the additional electric drive, the actuation of the motor vehicle lock can be prevented by means of the Bowden cable. The additional electric drive can hereby be used to insert a child safety lock or anti-theft lock, thereby uncoupling the first part of the Bowden cable from the second part of the Bowden cable. This can for example be realized by means of a coupling element, whereby the coupling element can be actuated electrically. The mechanical operative connection between the first part of the Bowden cable and the second part of the Bowden cable is hereby interrupted.

It is conceivable here that for example the second part of the Bowden cable is connected to an actuator in the functional unit, whereby for example a deflection unit is connected to the first part of the Bowden cable, so that an operative connection can be established via the deflection unit to the actuator to actuate the second part of the Bowden cable in the functional unit. The additional electric drive is then used to uncouple the first deflection unit from the actuator. This can happen by means of a coupling element that is to be actuated electrically.

If the coupling is closed, and if the deflection unit is actuated by means of the first part of the Bowden cable, then the actuation of the deflection unit can be detected directly as an actuation of the actuator. A switching device arranged on the actuator is used here, which in turn transfers a switching signal to the control unit, so that the electric drive can be actuated, which can then activate the actuator via for example a mechanical coupling. The activation of the actuator is then used to actuate the second part of the Bowden cable electrically or at least in an assisting manner. The lock can therefore be opened electrically or at least in part electrically by pulling the interior door handle.

In addition to this, a switching device can be arranged on the external door handle, whereby the switching device in turn transfers a control signal to the control unit to initialize the electric drive and move the actuator, so that the motor vehicle lock can be unlocked or opened or actuated.

4th embodiment: Procedure and device to electrically open a lock by means of an electric opening module (eÖFM), including an anti-theft lock, a child safety lock and a power lock.

In one embodiment, a first and second actuating medium is provided, whereby the actuator can be actuated by means of the actuating medium. The first and second actuating medium can for example be an external door handle and an interior door handle. The door handles are hereby for example connected to the functional unit via a Bowden cable. Every Bowden cable is hereby in operative connection with the actuator, so that when such a Bowden cable is actuated, the actuator can be moved or adjusted. The actuator itself is connected to the motor vehicle lock by means of a Bowden cable, so that when the actuator is moved in a linear direction and/or rotationally, the lock can be actuated.

If for the purpose of the invention, a Bowden cable is mentioned that is connected to the actuator, then an actuation of the Bowden cable causes an actuator in the lock to be locked, set, moved and/or actuated in general. A release lever is preferably actuated indirectly or directly as a result of the movement of the actuator, that is then used to unlock the locking mechanism. An advantage of using a functional unit is that any functions can be integrated in the functional unit, so that for example an anti-theft lock, child safety lock and/or a power lock can be mapped in the functional unit, so that the locking device can be equipped with a combination of a medium for actuating a functional unit, a control unit and a motor vehicle lock with a rudimentary, in other words, a motor vehicle lock that is reduced to the fundamental components of a motor vehicle. Put another way, a motor vehicle lock can be used that is merely equipped with a basic function consisting of a locking mechanism that includes a catch and at least a pawl.

If the first and/or second medium for actuating the actuator can be uncoupled, then this is a further embodiment of the invention. Uncoupling the actuating media causes the operative connection between for example the external door handle or interior door handle to and the motor vehicle lock to be inhibited. This in turn means that an interior door handle for example can be pulled without the actuator being able to move. A child safety lock or anti-theft lock can therefore be mapped on the Bowden cable or in the actuating link of the interior door handle in conjunction with a control unit and actuator. If for example the external door handle or actuating link between the external door handle and motor vehicle lock is interrupted, then a power lock can be mapped in the locking device through this interruption.

If the actuator can be uncoupled electrically, then this is a further embodiment of the invention. The actuator can for example be uncoupled electrically by arranging a coupling element that can be actuated electrically, between the first actuating medium and actuator and the second actuating medium and actuator. This enables a control unit to uncouple the first medium for actuating and/or the second medium for actuating the actuator. The functional chain of the actuating media can hereby be inhibited electrically in relation to the motor vehicle lock.

In one embodiment, there is then the advantage if uncoupling occurs by means of the electric drive and an actuator that captures the position of the actuator. The position of the actuator can for example be captured by means of a microswitch.

If a separate electric drive is provided to uncouple the first and second drive, then this a further advantageous embodiment of the invention. By integrating separate electric drives as drives for coupling between the actuating media and the actuator, every actuating medium can be uncoupled independently. If a switching device is then also arranged on the catch, then this switching device, for example a microswitch, can be used to design the anti-theft lock. The switching devices and electric drives in the functional unit are preferably connected to a control unit which converts the setting of the operator of the motor vehicle into control signals for the motors in order to actuate the couplings.

In a further advantageous embodiment of the invention, there is the advantage when the first deflection unit in the functional unit works together with the actuating medium and the position of the actuating medium can be captured by means of an actuator. If the actuation, for example of an interior door handle, is captured by a switching device as an actuating medium, then a child safety lock can for example be realized. Depending on the embodiment, a child safety lock is designed in such a way that when the interior door handle is pulled for the first time, this causes for example an adjustment of the coupling between the first actuating medium and actuator. If the interior door handle is actuated a second time, the lock can then be opened. Alternatively, there is also the option that pulling the interior door handle several times deactivates the child safety lock. The switching device on the first actuating medium in conjunction with the control unit is hereby one option to map a child safety lock in the functional unit.

5th Embodiment: Procedure and Device to Actuate Functions of a Lock, in Particular to Electrically Open a Lock by Means of an Electric Opening Module (eÖFM), Including an Anti-Theft Lock, a Child Safety Lock and a Power Lock, with the Help of a Comfort Module The purpose of the invention is solved by a locking device comprising a motor vehicle lock with a locking mechanism that includes a catch and at least a pawl, at least one medium to actuate the motor vehicle lock and a Bowden cable arranged between the motor vehicle lock and the actuating medium and a functional unit with an electric drive arranged on the Bowden cable, whereby the first actuating medium, in particular an external actuating lever is connected directly to the motor vehicle lock and the functional unit is integrated in a second actuating medium. By actuating the lock by means of the functional unit, this opens up the possibility that the lock can for example be unlocked, actuated or locked independently or at least to some extent independently. This simply requires initialization from the user to trigger or stop a function in the lock. The user simply has to initialize the pulse or signal to actuate the functional unit indirectly or directly. The lock can hereby be actuated directly via the Bowden cable connected to the external door handle, and via the functional unit integrated in the second Bowden cable.

Various locks and actuating levers can be used as a locking device for a motor vehicle. The locking device can be used as a compact constructional unit, for example in a lateral door, a sliding door or in the vicinity of flaps or lids or covers. Furthermore, it is also conceivable that for instance hood latches, auxiliary locks, as found for example in transporters, are used.

An internal or external actuating lever may for example be used as an actuating lever, such as for example a door handle. It is however also conceivable that sensitive means such as touch-sensitive switches and/or pressure switches or buttons are used to initialize the functional unit.

The locking device is used where a Bowden cable is used between the actuating lever and a lock. The Bowden cable consists of a Bowden cable sleeve and a Bowden cable core, whereby the Bowden cable sleeve is split, in other words, is made up of at least two parts that on the one hand support themselves in the actuating lever and in the functional unit and on the other hand in the functional unit and the lock to be actuated. To put it another way, the Bowden cable sleeve consists of at least two parts and extends from between the actuating lever and the functional unit and the functional unit and the lock to be actuated. The retainer surfaces or retainers for the ends of the parts of the Bowden cable sleeve in the actuating element or on the actuating element, functional unit and in or on the lock are retained in such a way that the Bowden cable sleeve is supported. Bowden cable sleeve parts that are fixed in the actuating lever, functional unit and lock are preferable.

The functional unit includes an electric drive that after initialization or after having received a control signal, moves the functional unit in such a way that the lock can be actuated or at least actuated in an assisting manner by means of the functional unit. The electric drive is preferably an electric motor. Electric motors are advantageous, since they are quiet, are available in a wide range and can be easily integrated in a motor vehicle or functional unit. If the lock is then subsequently actuated by means of the functional unit, then according to the invention, the operability of the locking device is simplified which in turn helps increase the comfort of the motor vehicle.

In one embodiment, the Bowden cable consists of two parts, whereby the first part of the Bowden cable is arranged between the interior door handle and functional unit and the second part of the Bowden cable is arranged between the functional unit and motor vehicle lock. By integrating the functional unit in the Bowden cable, this provides the possibility to use the Bowden cable directly as an actuating medium. The first actuator can hereby be moved by means of the interior door handle, which in turn works together with a second actuator, whereby the second actuator is connected to the second part of the Bowden cable. The movement of the second actuator then causes the Bowden cable to be pulled, thereby enabling the lock for example to be unlocked. A release lever is moved preferably indirectly or directly by means of the second part of the Bowden cable.

An actuator can hereby for example be a circular disk or a sliding element that works together with the additional actuator.

If the functional unit has an actuator, whereby the actuator can be actuated by means of the interior door handle, then this is a further advantageous embodiment of the invention. The actuator can for example be a circular disk or at least be circular segment-shaped and be seated in the functional unit so that it can rotate or swivel. The rotational movement of the actuator connected to the interior door handle enables the rotational movement to be transferred to another actuator. Another actuator installed in the functional unit can hereby also be a circular disk or at least be circular segment-shaped.

If this additional actuator is also seated in the functional unit so that it can rotate or pivot, then a rotational movement of the interior door handle can be transferred to the additional actuator as a swivel movement, whereby the additional actuator is connected with a second part of the Bowden cable to the lock.

In one further embodiment of the invention, the actuator can be actuated by means of a deflection unit. The interior door handle can also be connected to a deflection unit which transfers the pull movement of the interior door handle or Bowden cable core of the first Bowden cable part, to the functional unit. The deflection unit can hereby convert the pull movement of the interior door handle into a rotational movement and/or control movement. This movement of the deflection unit then allows, either indirectly or directly, the additional actuator or the actuator that is connected to the second part of the Bowden cable, to be actuated.

The deflection unit can be advantageously uncoupled from the actuator by means of the electric drive. If the deflection unit or the first actuator can be uncoupled from the additional actuator by means of an electric drive, then for example an anti-theft lock can be simulated for the door lock. A command from the operator is hereby implemented by means of a control unit, that the first actuator is being uncoupled from the second actuator. Pulling the interior door handle then comes to nothing, in other words, the first part of the Bowden cable may be moved but cannot transfer the movement to the additional actuator or the second part of the Bowden cable. In this embodiment, an anti-theft lock can for example be integrated into the functional unit.

If actuation of the first part of the Bowden cable can be captured by means of a switching device, in particular by means of a control unit, then this is a further advantageous embodiment of the invention. A microswitch arranged on the first actuator or deflection unit, as a form of the switching device, then it enables the actuation of the interior door handle to be detected. A child safety lock can hereby be mapped in the functional unit in conjunction with the electrical uncoupling of the actuators and the switching device. In addition to this, an anti-theft lock can of course also be realized by means of the microswitch and in conjunction with the electrical uncoupling of the actuators. If, in addition to this, the motor vehicle lock has a medium for uncoupling the first actuating medium, in particular the external door handle, then this is a further advantageous embodiment of the invention. If the motor vehicle lock has a medium, for example an electric drive, that is used to uncouple the external door handle and in particular an outside operating lever in the motor vehicle lock, from the motor vehicle lock, then a power lock can be realized by means of the locking mechanism.

If the actuator is in the functional unit so as to be longitudinally displaceable, then this is a further advantageous embodiment of the invention. A longitudinally displaceable position of the first and/or second actuator means that little space is required for the functional unit. In addition to this, an actuator that moves in a linear direction is easy to position and can for example be accommodated in a guide in the housing of the functional unit. In addition to this, it is also conceivable that the actuator is accommodated in the functional unit so that it can rotate. A combination of actuators arranged in a longitudinally displaceable position and positioned so that they can rotate in the functional unit, is conceivable according to the invention.

The design of at least one actuator or deflection unit as a circular disk or circular disk section hereby offers a further embodiment of the invention. Having a circular disk element as actuator offers a very accurate transmission of the movement of the interior door handle, with easily adjustable torques to be transmitted.

BRIEF DESCRIPTION OF DRAWINGS

The invention is described in further detail below with reference to the attached drawings on the basis of a preferred exemplary embodiment. However, the principle applies that the execution example does not limit the invention, but only constitutes an advantageous execution form. The illustrated characteristics can be executed individually or in combination with other characteristics of the description.

DESCRIPTION OF DIAGRAMS

Figure 2:
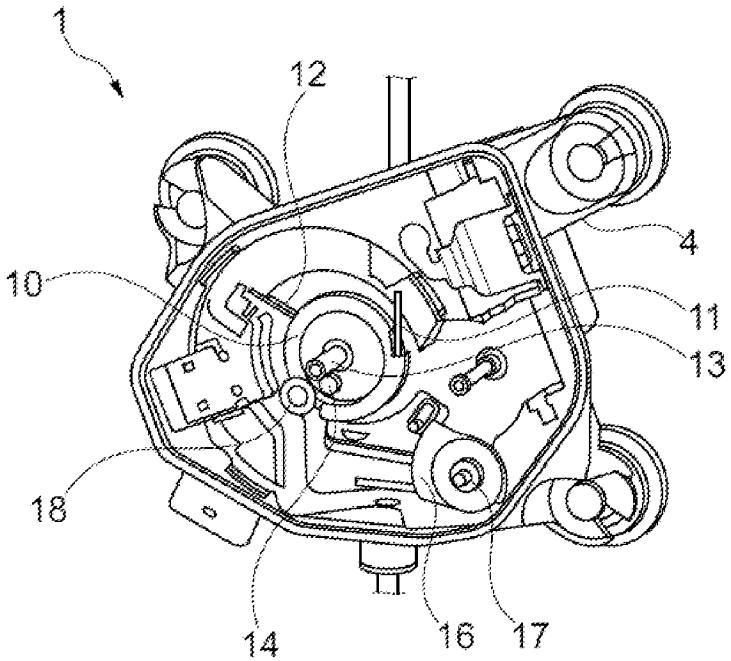
Figure 1:
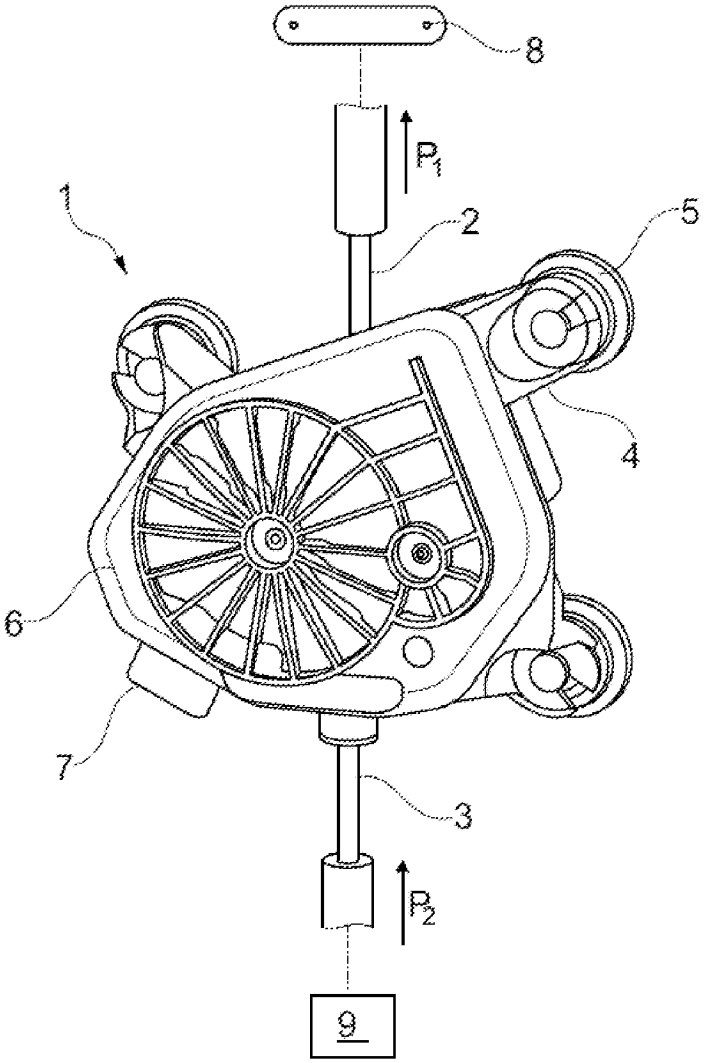
Figure 4:
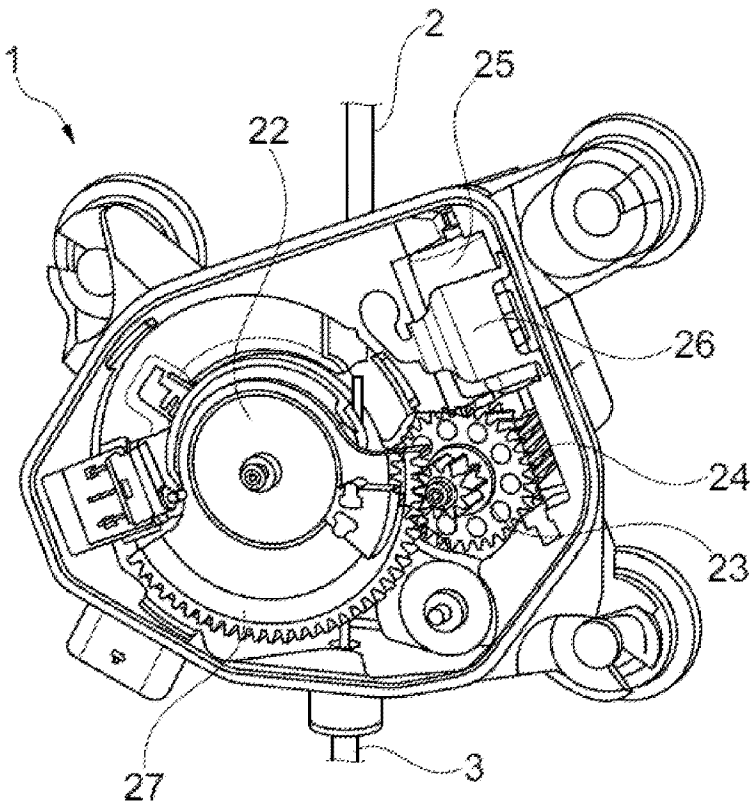
Figure 3:
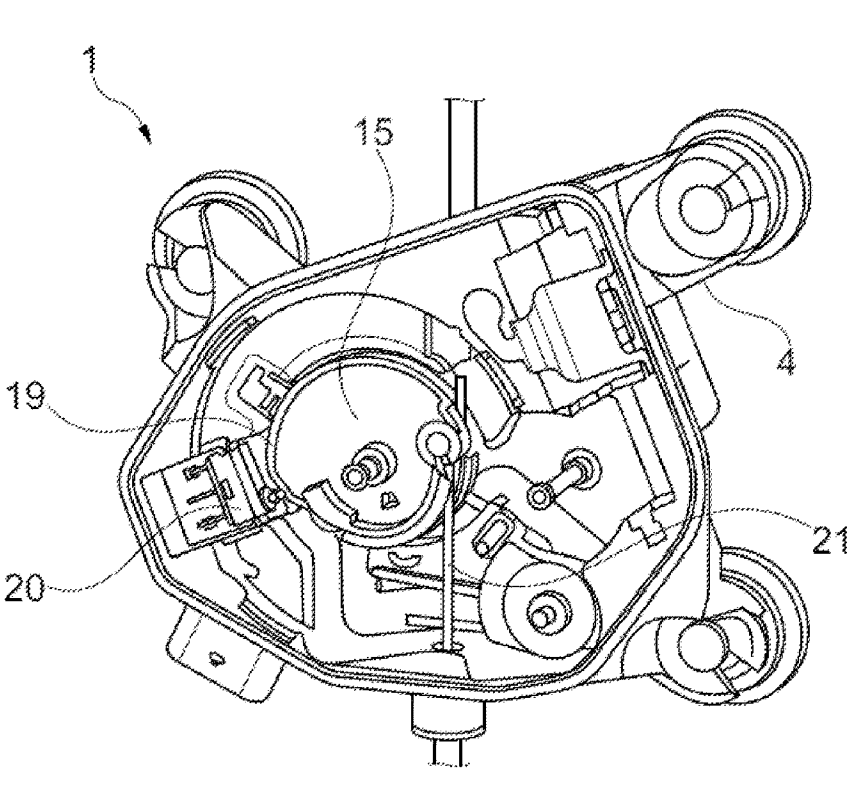
Figure 5:
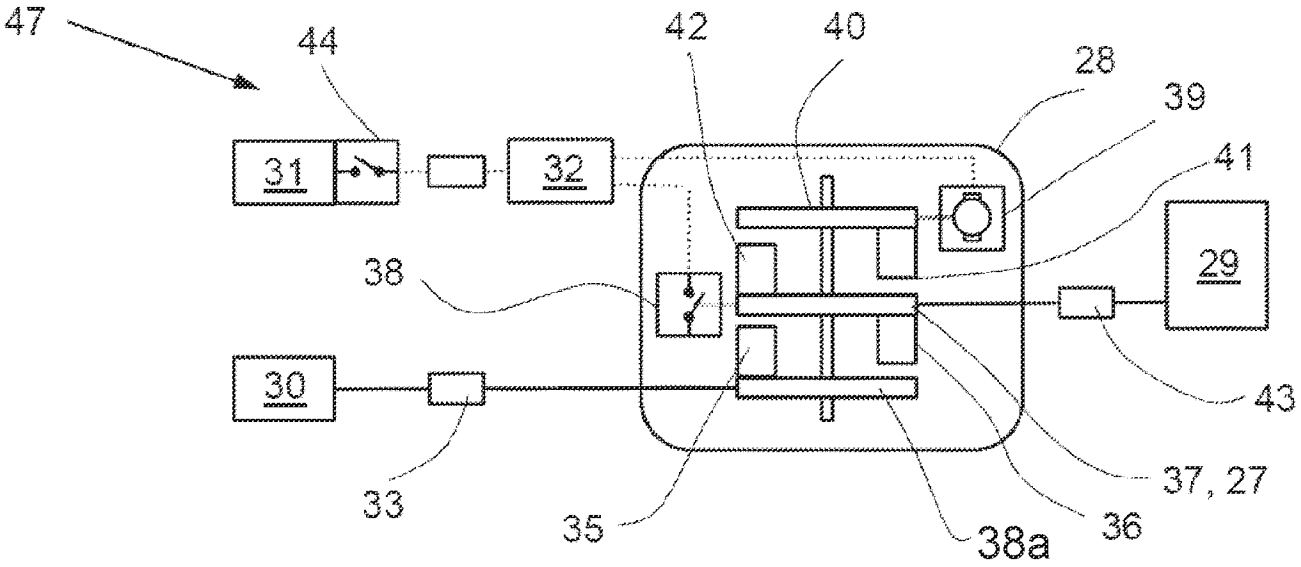
Figure 6:
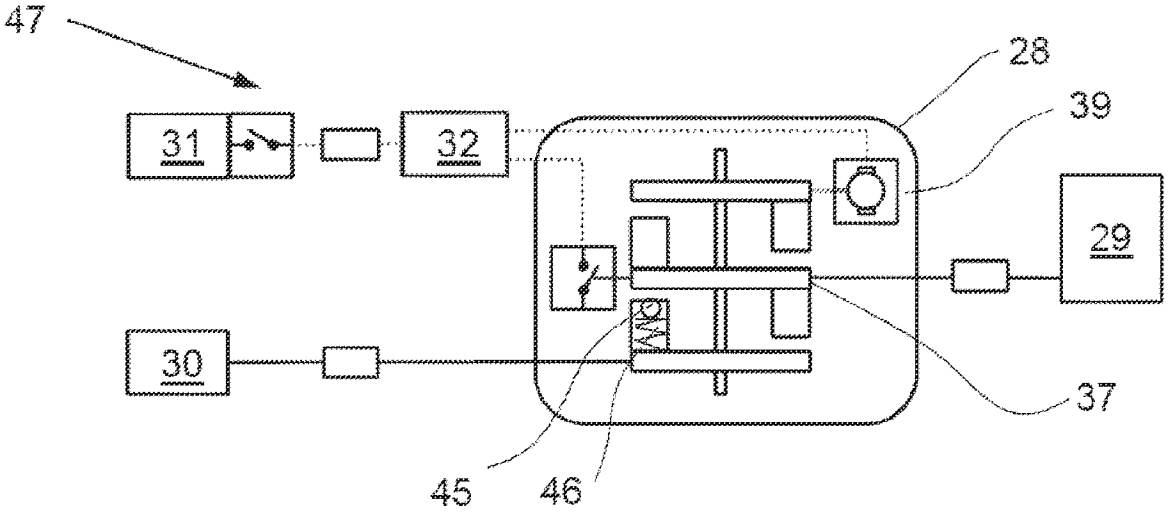
Figure 7:
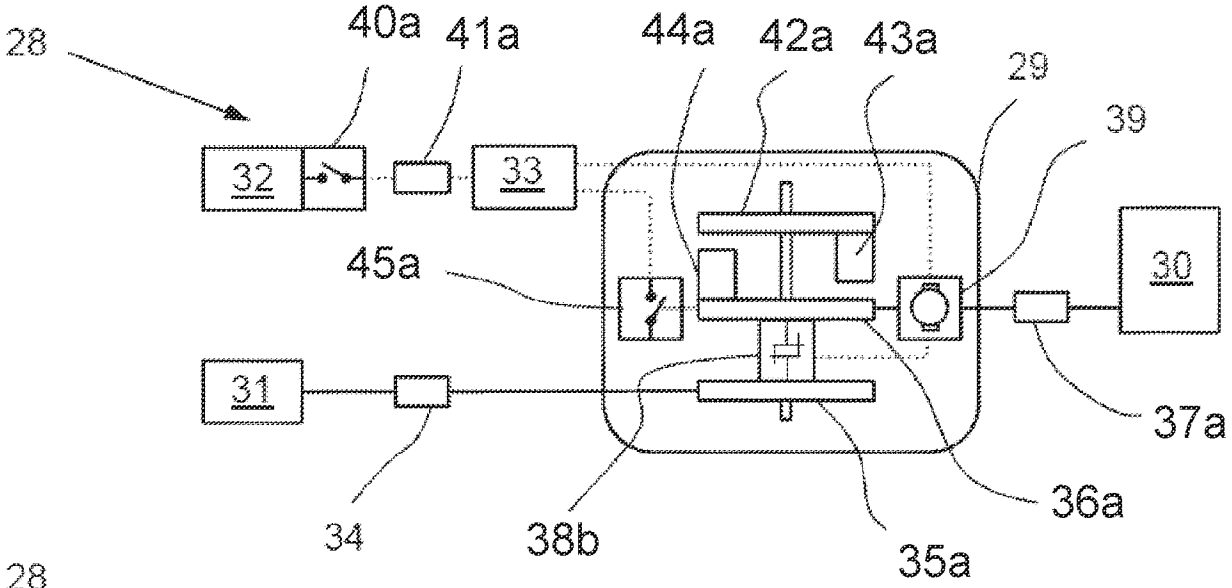
Figure 8:
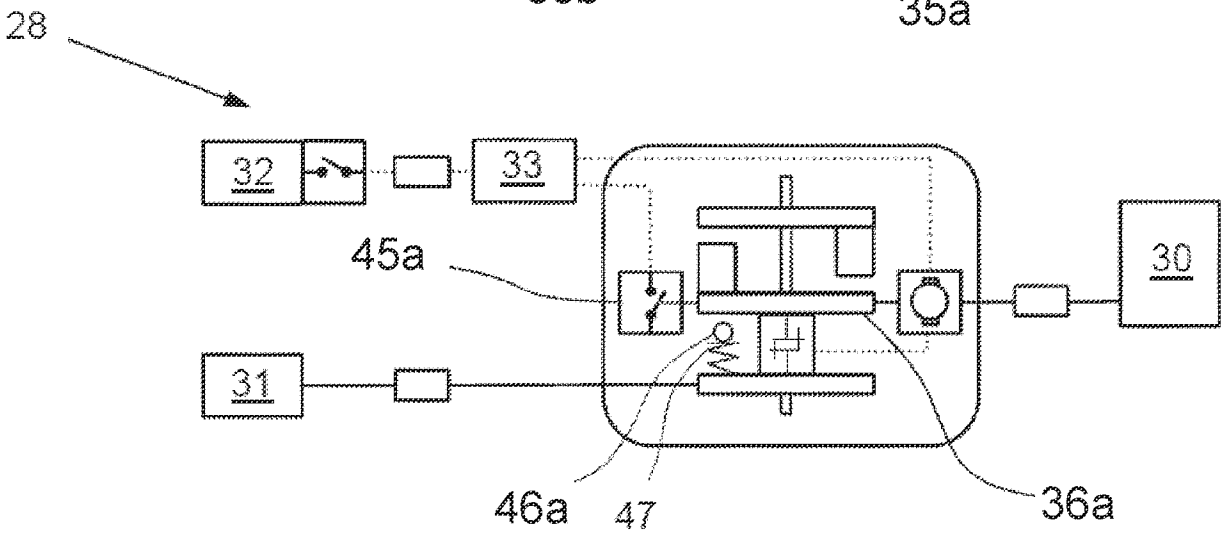
Figure 9:
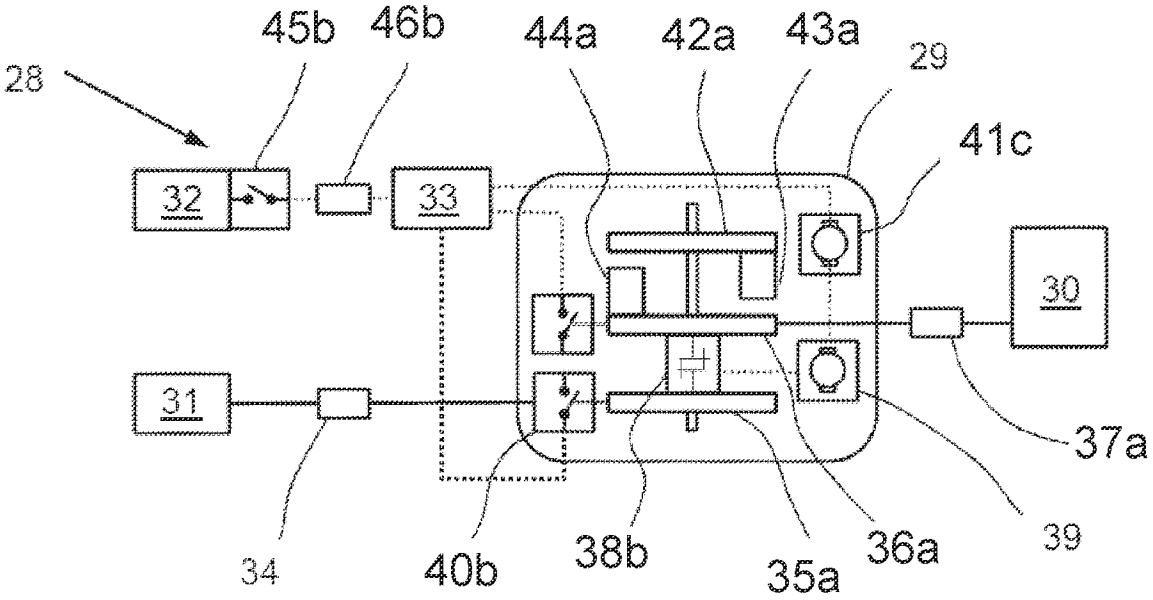
Figure 10:
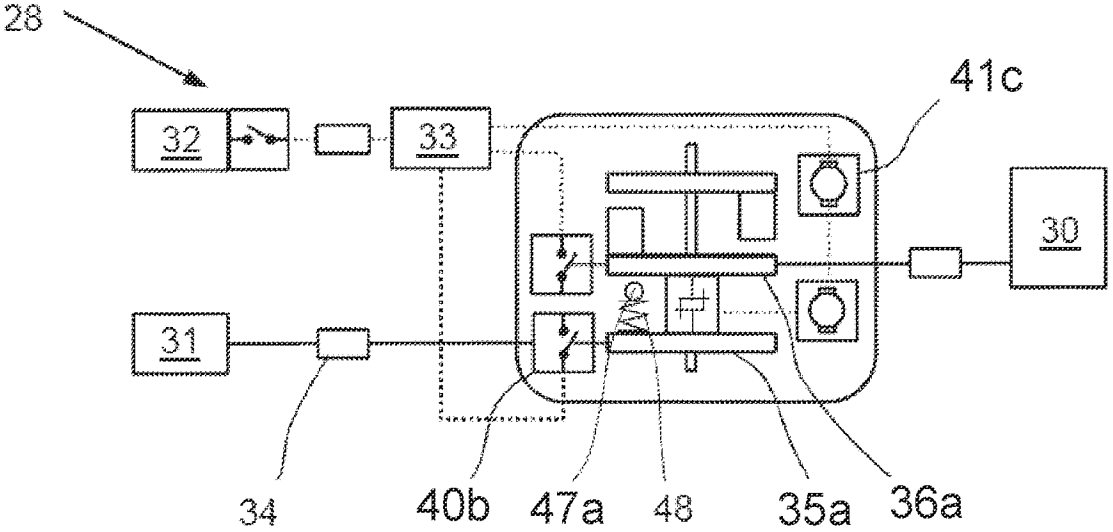
Figure 11:
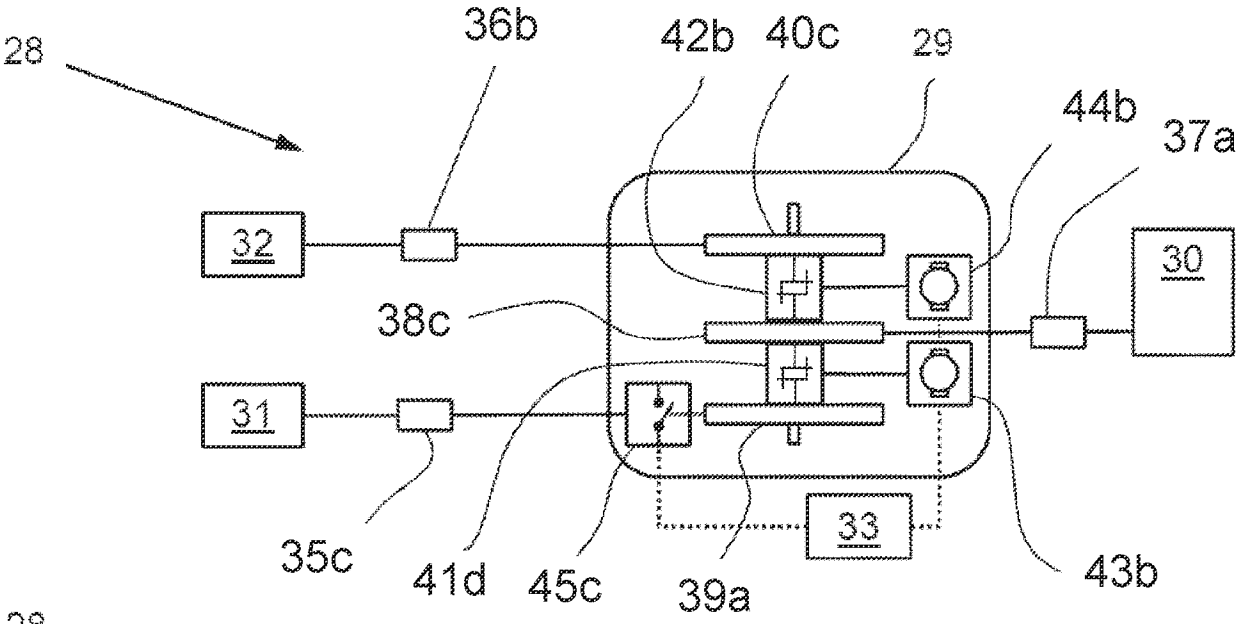
Figure 12:
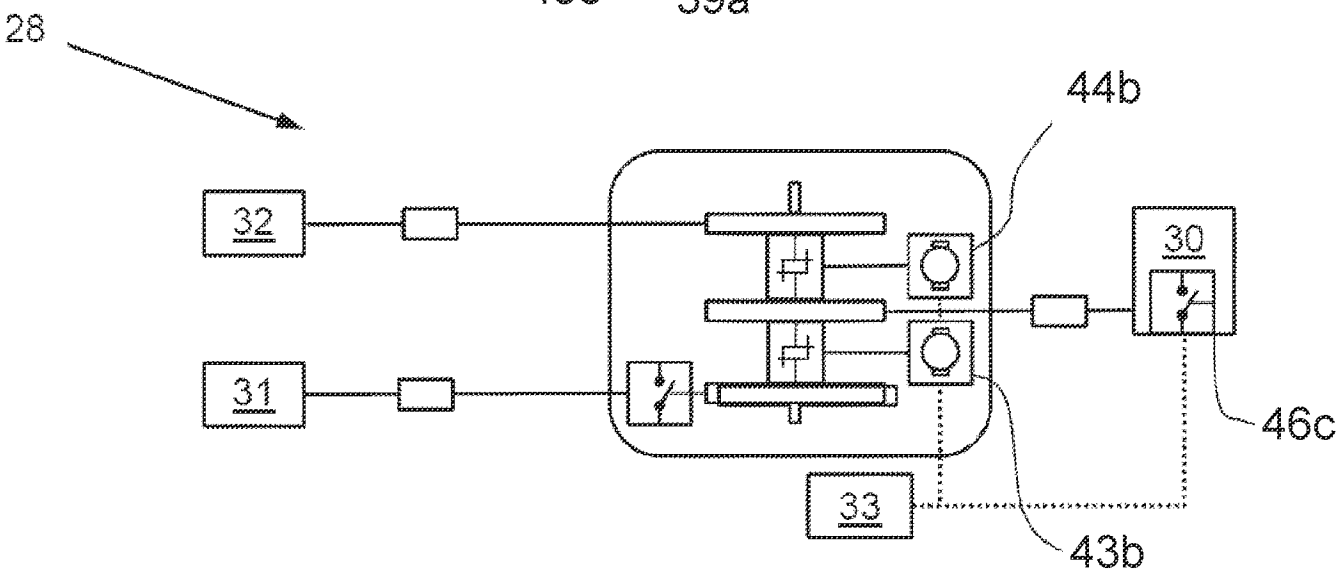
Figure 13:
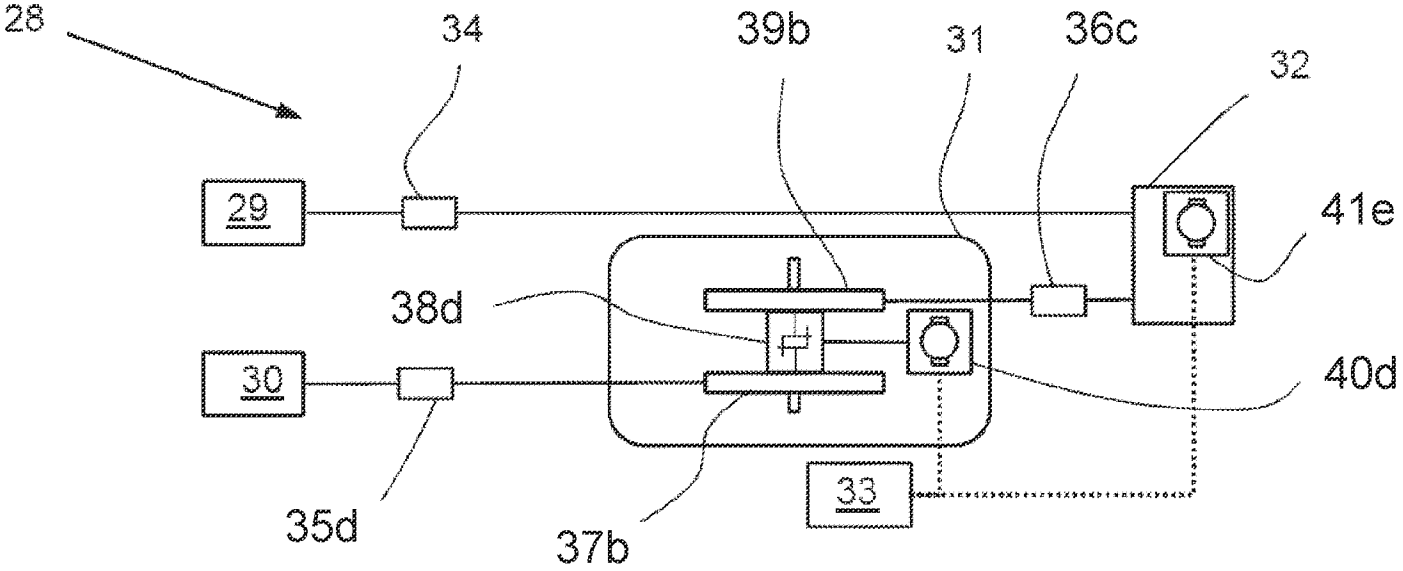
Figure 14:
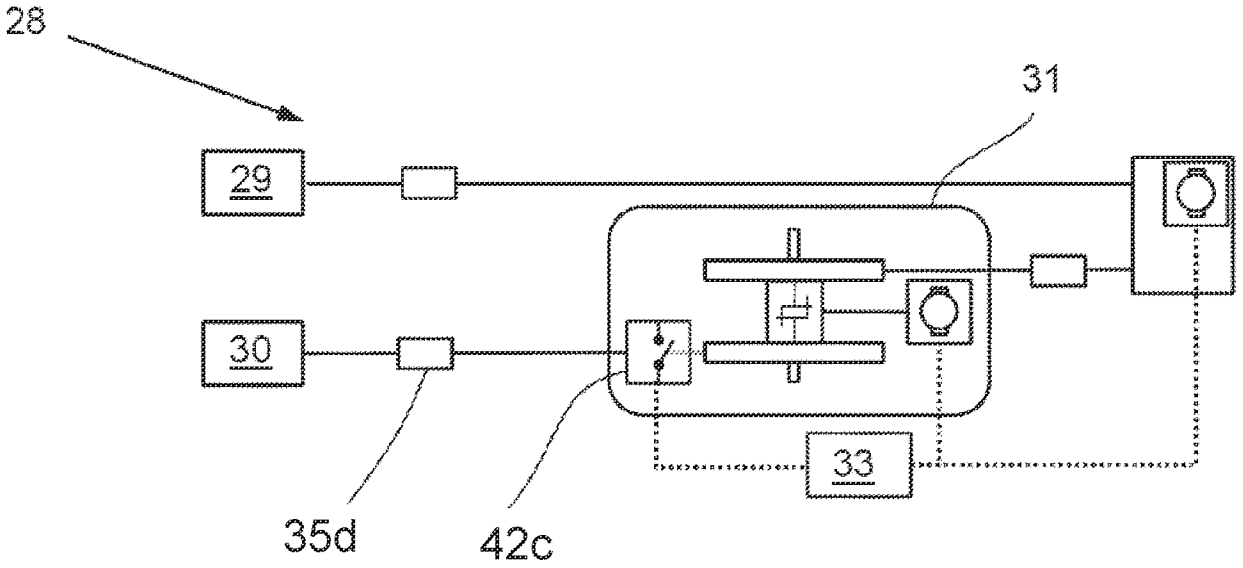

Depicted are:

FIG. 1A three-dimensional view of a functional module in the form of an opening module, whereby the opening module is arranged between two parts of a Bowden cable FIG. 2A top view of a functional unit in accordance with FIG. 1 with the connection of a first part of a Bowden cable to a first deflection unit, with dismount assistant FIG. 3 Another view of the functional unit with a second deflection unit that is connected to a second part of a Bowden cable FIG. 4A three-dimensional view of a functional unit with a drive element FIG. 5A general presentation of a functional unit with an actuating medium and a control unit as well as another medium to actuate the functional unit, whereby the functional unit is portrayed in conjunction with a motor vehicle lock FIG. 6A functional unit in accordance with FIG. 5 with a device for haptic feedback or a haptic acknowledgment for the operator FIG. 7A general presentation of a locking device for a motor vehicle with a coupling element integrated in the functional unit, that can be actuated electrically and FIG. 8 a general presentation of a locking device in accordance with FIG. 7 in an embodiment with a dismount assistant FIG. 9 a general view of a locking device for a motor vehicle with a functional unit, a motor vehicle lock, actuating media and a control unit FIG. 10 a general view of a locking device in accordance with FIG. 9 with an integrated dismount assistant FIG. 11 a general view of a locking device consisting of actuating media, a functional unit, control unit and motor vehicle lock FIG. 12 another schematic presentation of a locking device consisting of an actuating medium, functional unit and motor vehicle lock FIG. 13 a general presentation of a locking device in an alternative embodiment and FIG. 14 another embodiment of a locking device with another functionality.

DETAILED DESCRIPTION

FIG. 1 shows a three-dimensional view of a functional unit 1, whereby the functional unit 1 is arranged between the first part of a Bowden cable 2 and the second part of a Bowden cable 3. The housing 4 can be mounted for example to a door module in a motor vehicle by means of elastic fastening elements 5. The functional unit 1 has a housing cover 6 which protects and seals the housing 4 of the functional unit 1. A jack 7 is arranged on the housing 4 for the electrical connection of the functional unit.

The first part of the Bowden cable 2 is connected to an actuating lever 8, whereby the second part of the Bowden cable 3 is in operative connection with a lock 9. If the actuating lever 8 is actuated by an operator, whereby the first part of the Bowden cable 2 can be actuated in the direction of the arrow P1, then a movement of the Bowden cable core to the second part of the Bowden cable 3 is transferred via the functional unit 1, so that the Bowden cable core of the second part of the Bowden cable 3 is actuated in the direction of the arrow P2. The lock 9 can hereby be actuated by means of the actuating element 8 and via the Bowden cable 2, 3.

FIG. 2 shows a top view of the housing 4 of the functional unit 1 without the housing cover 6. A first deflection unit 10 can be seen, which is connected with a first part of a Bowden cable core 11. A torsion spring 12 moves the first deflection unit 10 back to the starting position, when the first deflection unit 10 has been deflected anticlockwise following actuation by means of the first part of the Bowden cable core 11. The torsion spring 12 then moves the first deflection unit 10 back to its starting position, whereby the first deflection unit is moved clockwise during resetting. Where there is mention of clockwise in the description of the exemplary embodiment, this describes a movement of the first deflection unit 10 around the axle 13. There is also a coupling element 14 arranged on the first deflection unit 10 with which the first deflection unit 10 can work together with a second deflection unit.

A control lever 16 is also shown that is spring-pretensioned in a clockwise direction around an axle 17. The control lever 16 hereby works together with a contour 18 on the first deflection unit 10, so that haptic feedback can be created for an operator.

If the first part of a Bowden cable core 11 is actuated by means of the actuating element 8, then the first deflection unit 10 moves anticlockwise around the axle 13, until the first deflection unit makes contact with the contour 18 of the control lever 16. The operator of the motor vehicle hereby receives haptic feedback, so that it is clear to the operator that the actuating lever 8 has been sufficiently actuated to activate or initiate the functional unit 1. If however, in the event of a power cut and/or in an emergency situation, the first part of the Bowden cable core 11 continues to be actuated, then the control lever 16 will slide beyond the contour 18 and pivot anticlockwise around the axle 17. The mechanical opening of the lock 9 is thereby guaranteed at any given time.

FIG. 3 shows the housing 4 of the functional unit 1, whereby a second deflection unit 15 is also placed on the axle 13. The second deflection unit 15 also has a control contour 19, whereby the control contour 19 works together with a switching device 20. A second part of a Bowden cable core 21 is connected to the second deflection unit 15, so that a rotational movement can be introduced to the second Bowden cable core 21.

If the first deflection unit 10 is then actuated by means of the actuating element 8, then the first deflection unit moves anticlockwise around the axle 13, whereby the contour 18 comes against the control lever 16 to the system.

The angle of rotation of the first deflection unit to reach the contour 18 on the control lever 16 is selected in such a way that the second deflection unit 15 has been twisted so far that the control contour 20 actuates the switching device 20. To move the second deflection unit 15 by means of the first deflection unit 10, the second deflection unit 15 has a positive connection that interacts with the coupling element 14. The positive fit preferably works only in an anticlockwise direction, so that the second deflection unit 15 can continue to be moved anticlockwise, without having to move the first deflection unit 10.

FIG. 4 shows the functional unit 1 with a drive element 22. The drive unit 22 is hereby driven by means of a transmission stage 23 and the transmission stage 23 by means of a worm drive 24. The worm gear 24 in turn is connected directly to an electric drive 25 in the form of an electric motor. The electric drive 25 is retained in the housing 4 of the functional unit 1 by means of an elastic retaining tab 26. The drive element 22 is designed as one piece with a partially circular gear segment 27, so that a favorable torque is available to actuate the second part of the Bowden cable core 21.

If the first Bowden cable core 11 is then actuated by means of the actuating element 8, then the second deflection unit 15 is actuated via the first deflection unit 10 and by means of the coupling element 14. Actuation of the second deflection unit 15 initializes the switch 20 designed as a microswitch by means of the control contour 19, so that the electric drive 25 receives a control signal and the drive element 27 is driven by means of the transmission stage 23. The drive element 22 hereby works with the second deflection unit 15, whereby the second deflection unit 15 can be driven anticlockwise. The operator comes against the contour 18 with the first deflection unit 10 and receives haptic feedback. The haptic feedback occurs exactly at the time when the switching signal is fed to the electric drive 25, so that as a result of the movement of the drive element 22 and via the second part of the Bowden cable core 21, the lock 9 is opened or unlocked or locked. The effect desired by the operator or the function desired by the operator takes place, so that there is no need to pull the operating element 8 again.

If the functional unit is used for example between an inside operating lever as an actuating element 8 and a lock 9 in a motor vehicle side door, then the functional unit 1 can be initialized by pulling the actuating lever 8 and just briefly pulling the actuating lever 8, so that the lock 9 is opened. In this case, the functional unit 1 acts as a dismount assistant, whereby the dismount is made easier for the operator, thus increasing the comfort in the motor vehicle.

1st Embodiment: Procedure and Device to Electrically Open a Lock by Means of an Electric Opening Module (eÖFM)

FIG. 5 shows a functional unit 28, a motor vehicle lock 29, an actuating element 30, 31 and a control unit 32. The actuating medium 30 is preferably an interior door handle which is connected to a first part of a Bowden cable 33 to a first deflection unit 34 in the functional unit 28. The first deflection unit 34 has a coupling element 35 that works together with a coupling element 36, so that the electric drive 39 can be moved. A switching device 38, for example in the form of a microswitch, is arranged on the actuator itself.

If the interior door handle 30 is pulled, then the first deflection unit 34 is moved, so that the coupling element 35 engages with the coupling element 36. The first actuator 37 is hereby mobile. The movement of the first actuator 37 is detected by means of the switching device 38, so that the control unit 32 can transfer a control signal to the electric drive 39, so that for example a gear segment 40 can be activated, whereby the coupling elements 41, 42 engage and the first actuator 37 can be moved. The movement of the first actuator 37 causes the second part of the Bowden cable 43 to be actuated, so that the motor vehicle lock 29 can be unlocked and/or actuated.

According to the invention, the electric drive 39 can however also be actuated via the actuating medium 31, for example an external door handle. The external door handle 31 hereby works together with a switching device 44 so that an electric signal can be transferred to the control unit 32. The control unit 32 hereby initializes and/or controls the electric drive 39 so that the first actuator 37 can be moved via the coupling elements 41,42.

FIG. 6 essentially shows an embodiment according to FIG. 5. In addition to this, the functional unit 28 in FIG. 6 has a dismount assistant. The dismount assistant hereby consists of a control lever 45, which works against the first actuator 37 by means of a spring 46. The operator of the interior door handle 30 receives haptic feedback by means of the control lever45, so that actuation can be completed. The haptic feedback is arranged in such a way that the acknowledgment directly coincides with the switching of the actuator 38*a* or after the actuator 38*a* has been actuated. The electric drive 39 can then be activated by means of the actuator 38*a* via the control unit 32. The control lever 45, in conjunction with the spring element 46, sends feedback to the operator to inform him that the interior door handle 30 has been pulled sufficiently.

2nd Embodiment

FIG. 7 shows a locking device 28, consisting of a functional unit 29, a motor vehicle lock 30, two actuating media 31, 32 and a control unit 33. The actuating element 31 is connected to a first part of a Bowden cable 34 to a deflection unit 35*a* in the functional unit 29. An actuator 36*a* is connected to the motor vehicle lock 30 via a second part of a Bowden cable 37*a*. A coupling element 38*b* that can be actuated electrically is arranged between the first deflection element 35*a* and the actuator 36*a*. Depending on the switching position of the coupling element 38*b* that can be actuated electrically, the actuator 36*a* can be moved or uncoupled from the actuator 36*a* by means of the actuating element 31. The electric drive 39 can be used advantageously to uncouple the first deflection unit 35*a*. To do so, the electric drive 39 is moved from a middle zero-position to an end position. This first end position then describes the uncoupled state of the first deflection unit.

A switching device 40*a* is allocated to the actuating medium 32, for example an external door handle. By actuating the actuating element 32, the switching device 40*a*, for example a touch-sensitive sensor, can be actuated, so that a control signal 41*a* can be transferred to the control unit 33. The control unit 33 then initializes the electric drive 39, so that the actuator 36*a* is mobile and the actuator 36*a* can be activated for example via a gear segment 42*a*. The gear segment 42*a* hereby acts on a coupling element 43*a*, which in turn can work together with a coupling element 44*a* on the actuator 36*a*.

If the coupling element 38*b* is closed, and if the actuating medium 31 is pulled, then the actuator 36*a* is moved which in turn can be detected by means of an actuator, so that a control signal can be transferred to the control unit 33 and the control unit 33 can act upon the electric drive 39, so that the motor vehicle door lock can be opened or actuated with electrical assistance or electrically.

FIG. 8 essentially shows the locking device 28 according to FIG. 5. A control lever 46*a* is against the actuator 36*a* in a spring-pretensioned manner, in other words, by means of a spring element 47. The control lever 46*a* is used to give the operator haptic feedback or a haptic acknowledgment, to inform him that the actuating element 31 has been pulled sufficiently to actuate the switching device 45*a*. The electrical opening can now be initiated by means of the control unit 33. The haptic feedback by means of the control lever hereby allows a dismount assistant to be realized, whereby for example the interior door handle 31 only has to be actuated so far until the switching device 45*a* generates a signal and the electrical opening process can be started. This kind of activation enables the motor vehicle lock 30 to be opened with very little force and little stroke distance, which leads to a comfort function for the operator, since the motor vehicle lock 30 can be opened with as little as possible actuating forces on the actuating element 31.

3rd Embodiment

FIG. 9 shows a locking device 28 with a functional unit 29, a motor vehicle lock 30, actuating media 31, 32 and a control unit 33. A first part of a Bowden cable 34 is arranged between the actuating medium 31 and a deflection unit 35*a*. An actuator 36*a* is connected to the motor vehicle lock 30 via a second part of a Bowden cable 37*a*. A coupling element 38*b* is provided between the deflection unit 35*a* and the actuator 36*a*, which can be switched by means of another electric drive 39.

A switching device 40*b* is arranged on the deflection unit 35*a* and captures a movement between the first part of the Bowden cable 34. If the interior door handle 31 is hereby pulled, then the first part of the Bowden cable 34 is actuated, which can be captured and transferred as a switching signal to the control unit 33 via the switching device 40*b*. If the coupling element 38*b* is hereby coupled in, then a control signal is transferred to the electric drive via the control unit 33, which in turn activates, for example a gear segment 42*a*, so that the actuator 36*a* can be activated via the coupling elements 43*a*, 44*a*.

Initialization of the electric drive 41*c* is also possible via the actuating medium 32. An switching device 45*b* is also allocated to the actuating medium 32, which in turn transfers a control signal 46*b* to the control unit 33, whereby the control unit 33 can in turn activate and actuate the electric drive 41*c*.

As a result of the additional electric drive 39, the functional unit 29 is able to uncouple the first deflection unit 35*a* from the actuator 36*a*. By using the switching device 40*b*, it is hereby possible to capture the actuation of the actuating medium 31 and to release or uncouple the coupling 38*b* subject to the anti-theft lock or child safety lock that is installed. A child safety lock and anti-theft lock are hereby possible in the functional unit 29.

FIG. 10 shows a general overview of a locking device 28, whereby the structure of the locking device 28 resembles that of the locking device 28 in accordance with the embodiment of FIG. 4. In addition to this, the locking device 28 in accordance with FIG. 10 has a dismount assistant. The dismount assistant hereby has a control lever 47*a* which works together with the actuator 36*a* via a spring element 48. If the actuating medium 31 is hereby actuated and the first part of the Bowden cable 34 moves the deflection unit 35*a*, then the operator of the actuating medium 31 receives haptic feedback, in other words, acknowledgment that the deflection unit 35*a* is moving against a control contour. This haptic acknowledgment occurs a time when the switching device is actuated.

The control unit 33 is hereby sent a switching signal via the switching device 40*b*, that in turn is used to initialize electric drive 41*c*, so that the functional unit can actuate the lock 30. The operator hereby only has to actuate the actuating medium 31 very briefly, preferably the interior door handle, to actuate the lock 30. The actuation of the lock 30 is hereby assisted by means of the functional unit 29, so that an assistant system in the form of a comfort module can be created. The comfort is hereby increased in that manual actuation of the Bowden cable simply has to occur so that the switching device 40*b* in the functional unit 29 has to be actuated.

4th Embodiment

FIG. 11 shows a locking device 28. This locking device 28 consists of a functional unit 29, a lock 30, a first actuating medium 31 and a second actuating medium 32 and a control unit 33. The actuating media 31, 32 are connected by a Bowden cable 34, 35*c* to the functional unit 29. Another Bowden cable 37*a* is arranged between the motor vehicle lock and an actuator 38*c*.

In this embodiment, the actuating elements 31, 32 work together with one deflection unit respectively. In other words, the Bowden cable 35 is connected to the deflection unit 39*a* and the Bowden cable 36 is connected to the deflection unit 40*c*. The actuator 38*c* in the functional unit 29 is arranged between the deflection units 39*a*, 40*c* and connected to the actuator 38*c* by means of an electric coupling 41*d*, 42*b*. The coupling elements 41*d*, 42*b* are connected to the electric drives 43*b*, 44*b* and can be actuated or coupled or uncoupled by means of the electric drives 43*b*, 44*b*. A switching device 45*c* is arranged on the first deflection unit or in the actuating link of the Bowden cable 35*c*.

The switching device in turn is connected electrically to the control unit 33, so that a control signal can be transferred from the control unit to the electric drive 43*b*. The control unit 33 in turn is connected electrically to the switching device 45*c* and the electric drives 43*b*, 44*b*.

The locking device 28 allows a power lock, an anti-theft lock and a child safety lock to be mapped in the functional unit 29. The power lock can be inserted via the control unit 33, electric drive 44*b* and coupling element 42*b*. The Bowden cable 36*b* or the actuating medium 32 is hereby uncoupled from the actuator 38*c*. An anti-theft lock or a child safety lock can be mapped in the functional unit 29 by means of the control 33, electric drive 43*b*, coupling element 41*d* and switching device 45*c*.

FIG. 12 shows a locking device 28 in accordance with FIG. 5, whereby an additional switching device 46*c* is arranged in the motor vehicle lock 30. The switching device 46*c* monitors the position of the catch. The design of the anti-theft lock can be controlled by surveying the catch switch 46*c*. A power lock and anti-theft lock can be mapped with a locking device 28 in accordance with FIG. 12.

It is however important to mention that the functional unit 29 can also be developed with just an electric drive 43*b*, 44*b*, whereby an additional microswitch is needed though for the electric drive 43*b*, 44*b*, so that a middle zero-position of the electric drive 43*b*, 44*b* can be determined. Depending on the rotational movement of the electric drive, an anti-theft lock or power lock can then be mapped in the functional unit 29.

5th Embodiment

FIG. 13 shows a locking device 28 with an external door handle 29, an interior door handle 30 as actuating medium, a functional unit 31, a motor vehicle lock 32 and a control unit 33. A Bowden cable 34 is arranged between the external door handle 29 and the motor vehicle lock 32. A first part of a Bowden cable 35*d* is in operative connection with a second part of a Bowden cable 36*c* via the functional unit 31. The functional unit 31 has a first actuator 37*b* that is connected with another second actuator 39*b* via a coupling element 38*d*. The coupling element 38*d* in this embodiment is designed as an electric coupling element 38*d* and can be uncoupled or coupled by means of the electric drive 40*d*. The motor vehicle lock also has another electric drive 41*e* that is used to uncouple the external door handle 29 from the motor vehicle lock 32.

If the external door handle is connected for example to an external actuating lever in the motor vehicle lock 32 by means of the Bowden cable 34, then the motor vehicle lock 32 can for example be unlocked by means of the external door handle 29.

Another option to unlock the motor vehicle lock 32 is to pull the interior door handle 30, whereby the first actuator 37*b* is moved via the first part of the Bowden cable 35*d* and, in the case of the coupled in coupling 38*d*, the second actuator 39*b* can be moved. The movement of the other actuator 39*b* then causes the Bowden cable core of the Bowden cable 36*c* to unlock the motor vehicle lock 32 for example.

The Bowden cable 34 can be uncoupled from the motor vehicle lock by means of the electric drive 41*e* in the motor vehicle lock 32 and a power lock can be mapped in the locking device 28.

The first actuator 37*b* can be uncoupled from the other actuator 39*b* by means of the electric drive 40*d*, so that for example an anti-theft lock can be mapped in the locking device 28.

FIG. 14 shows a general view of a locking device 28, whereby the functional unit 31 also has a switching device 42*c*. Actuation of the first part of the Bowden cable 35*d* can be captured or detected by means of the switching device 42*c*. Actuation of the first part of the Bowden cable 35*d* by means of the interior door handle 31 causes the switching device 42*c* to generate a signal, which in turn can be captured by the control unit 33, so that for example a child safety lock can be mapped in the locking device 28.

The invention claimed is:

1. A locking device for a motor vehicle comprising:

an actuating lever;

a lock;

a Bowden cable which is arranged between the actuating lever and the lock, wherein the lock is configured to be actuated by the actuating lever and the Bowden cable; and a functional unit which is arranged on the Bowden cable and has an electric drive, wherein the lock is configured to be actuated by the functional unit, at least in an assisting manner, or an actuation of the lock is configured to be prevented by the functional unit, wherein the functional unit includes at least one deflection unit configured to deflect the Bowden cable, wherein the functional unit includes a drive element and a drive configured to activate the at least one deflection unit, wherein the drive is a gear stage connected between the electric drive and the drive element;

wherein the at least one deflection unit includes a first deflection unit connected to a first part of the Bowden cable and a second deflection unit connected to a second part of the Bowden cable, wherein the first deflection unit and the second deflection unit are configured to be activated by the drive element;

wherein the first deflection unit and the second deflection unit are rotatably mounted on a common central axle and are coupled by a coupling element, whereby the second deflection unit is actuated by rotation of the first deflection unit via the coupling element; and wherein the functional unit further includes a switching device that provides a control signal to the electric drive, wherein the second deflection unit includes a contour that actuates the switching device when the second deflection unit is actuated.

2. The locking device according to claim 1, wherein the drive element is made up of a gear segment.

3. The locking device according to claim 1, wherein the functional unit includes a control lever, whereby a movement of the at least one deflection unit is configured to be at least partially blocked by the control lever.

4. The locking device according to claim 1 further comprising an actuator and an additional actuating medium that works together with the actuator in such a way that a haptic acknowledgment is configured to be captured for an operator of the additional actuating medium.

5. The locking device according to claim 4, wherein the haptic acknowledgment is configured to be captured after or immediately during the actuation of the switching device.

6. The locking device according to claim 1 wherein:

the first part of the Bowden cable is arranged between an activating lever and the functional unit;

the second part of the Bowden cable is arranged between the functional unit and the lock; and a mechanical connection is arranged on the first part of the Bowden cable that is configured to be uncoupled from the second part of the Bowden cable.

7. The locking device according to claim 1 further comprising an actuator, wherein the at least one deflection unit is configured to be uncoupled from the actuator by the electric drive.

8. A locking device for a motor vehicle comprising:

an actuating lever;

a lock;

a Bowden cable which is arranged between the actuating lever and the lock, wherein the lock is configured to be actuated by the actuating lever and the Bowden cable; and a functional unit which is arranged on the Bowden cable and has an electric drive, wherein the lock is configured to be actuated by the functional unit, at least in an assisting manner, or an actuation of the lock is configured to be prevented by the functional unit, wherein the functional unit includes at least one deflection unit configured to deflect the Bowden cable, wherein the functional unit includes a drive element and a drive configured to activate the at least one deflection unit, wherein the drive is a gear stage connected between the electric drive and the drive element;

wherein the at least one deflection unit includes a first deflection unit connected to a first part of the Bowden cable and a second deflection unit connected to a second part of the Bowden cable, wherein the first deflection unit and the second deflection unit are configured to be activated by the drive element;

wherein the first deflection unit and the second deflection unit are rotatably mounted on a common central axle and are coupled by a coupling element, whereby the second deflection unit is actuated by rotation of the first deflection unit via the coupling element;

wherein the first part of the Bowden cable is arranged between an activating lever and the functional unit, the second part of the Bowden cable is arranged between the functional unit and the lock, and a mechanical connection is arranged on the first part of the Bowden cable that is configured to be uncoupled from the second part of the Bowden cable; and wherein uncoupling of the Bowden cable is configured to be performed by the electric drive.

9. The locking device according to claim 8 further comprising an actuator that is connected to the lock via the second part of the Bowden cable, and an actuating lever that works together with the actuator in such a way that a haptic acknowledgment is configured to be captured for an operator.

10. The locking device according to claim 9, wherein the functional unit has at least one switching device, wherein the switching device is arranged in the functional unit such that the haptic acknowledgment is configured to be captured after or immediately during the actuation of the switching device.

11. A locking device for a motor vehicle comprising:

an actuating lever;

a lock;

a Bowden cable which is arranged between the actuating lever and the lock, wherein the lock is configured to be actuated by the actuating lever and the Bowden cable; and a functional unit which is arranged on the Bowden cable and has an electric drive, wherein the lock is configured to be actuated by the functional unit, at least in an assisting manner, or an actuation of the lock is configured to be prevented by the functional unit, wherein the functional unit includes at least one deflection unit configured to deflect the Bowden cable, wherein the functional unit includes a drive element and a drive configured to activate the at least one deflection unit, wherein the drive is a gear stage connected between the electric drive and the drive element;

wherein the at least one deflection unit includes a first deflection unit connected to a first part of the Bowden cable and a second deflection unit connected to a second part of the Bowden cable, wherein the first deflection unit and the second deflection unit are configured to be activated by the drive element;

wherein the first deflection unit and the second deflection unit are rotatably mounted on a common central axle and are coupled by a coupling element, whereby the second deflection unit is actuated by rotation of the first deflection unit via the coupling element; and further comprising:

a first and second actuating medium; and a separate electric drive to uncouple the first and second actuating medium.

12. The locking device according to claim 11, wherein the at least one deflection unit works together with the first and second actuating medium; and wherein the functional unit includes a switching device, wherein the position of at least one of the first and second actuating medium is configured to be captured by the switching device.

13. The locking device according to claim 11 further comprising an actuator, wherein at least one of the first and second actuating medium works together with the actuator in such a way that a haptic acknowledgment is configured to be captured for an operator.

14. The locking device according to claim 13, wherein the actuator is positioned so as to be longitudinally displaceable in the functional unit.

* * * * *